United States Patent [19]

Settlemire

[11] 4,217,485

[45] Aug. 12, 1980

[54] PLURAL KEY OPERATED TOTALIZERS FOR GASOLINE SALES PUMP

[75] Inventor: Eugene F. Settlemire, Tucson, Ariz.

[73] Assignee: Austin A. Webb, Kalamazoo, Mich.

[21] Appl. No.: 6,534

[22] Filed: Jan. 25, 1979

[51] Int. Cl.[2] ..... B67D 5/22

[52] U.S. Cl. ..... 235/94 R; 235/117 R

[58] Field of Search ..... 235/94 R, 95 R, 117 R

[56] References Cited

U.S. PATENT DOCUMENTS

| | | | |
|---|---|---|---|
| 3,026,032 | 3/1962 | Settlemire | 235/94 R |
| 3,422,676 | 1/1969 | Wilson | 235/94 R |

*Primary Examiner*—L. T. Hix
*Assistant Examiner*—Benjamin R. Fuller
*Attorney, Agent, or Firm*—Austin A. Webb

[57] ABSTRACT

A plate adapted to be mounted over an opening in the casing of a gasoline sales pump supports a frame which in turn rotatably and axially slidably supports a plurality of totalizer shafts and dial wheels, and a drive shaft with plural gears each associated with one of the totalizers. Each totalizer shaft has a gear engagable with a gear on the drive shaft by axial motion of the totalizer shaft. A drive gear on the drive shaft is permanently connected to the resettable register of the pump. Springs bias the totalizer shafts out of engagement with the drive shaft gears. Actuating levers pivoted on the plate engage the totalizer shafts in opposition to the springs. A selector bar slidable through the plate opposite each level has an angled end that cams the lever to totalizer engaging position. Springs bias the selector bars, and plural locks having key actuated cylinders move the selector bars against their springs. Two detents or slide bars supported on opposite sides of the selector bars have cam openings that coact with the opposite ends of pins projecting from the selector bars to prevent depression of a second lock cylinder and selector when another is already depressed, and to release the first actuated detent by linial movement of the other detent. Springs bias the detents oppositely. An electric switch is located to be closed when one of the detents is displaced. A lever adapted to be connected to the reset shaft of the sales register of the gasoline pump is positioned to move the other detent. The switch is adapted to be connected in series with the delivery control circuit of the pump.

5 Claims, 4 Drawing Figures

PLURAL KEY OPERATED TOTALIZERS FOR GASOLINE SALES PUMP

OUTLINE OF INVENTION

The present invention is an improvement of the key operated individual totalizers shown in my U.S. Pat. No. 3,026,032, and adapts key actuated totalizers to present day gasoline pumps with mechanically interlocked pump actuating switches and reset mechanisms for zeroing visible registers before each sale. Where the prior totalizer used axially fixed shafts and sets of numeral dials, the present invention uses totalizers or cumulative total recorders in which the shafts bearing the numeral dials or wheels are axially movably supported. Gears fixed axially on each shaft are selectively moved into mesh with other driving gears on a common drive shaft which is rotated at any time the pump and the visible sale recording register of the pump are driven. The axially shiftable nature of the individual totalizers permits the use of business or adding machine detent or slide bars and coacting key operated lock slides to engage only a selected on of several individual totalizers as a necessary requirement for each actuation of the sales pump; and to disengage the totalizer after one sale and prior to another sale. Individual shifting levers pivoted between the ends of the shafts of the individual totalizers and the coacting key actuated locks effect engagement of the totalizers by actuation of the locks.

DETAILED DESCRIPTION

The drawings, of which there are three sheets, illustrate a preferred form of the invention.

Figure 4:
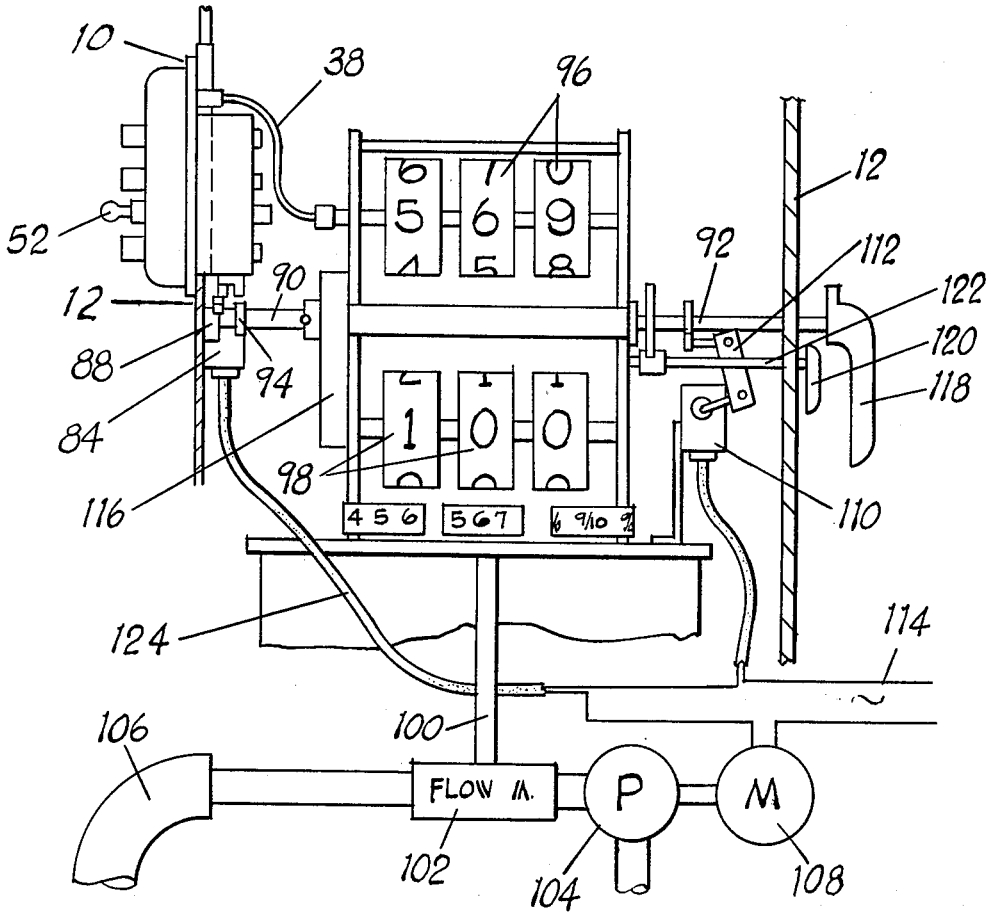
FIG. 4 is a fragmentary assembly view, conventionally illustrating parts of a gasoline sales register with the totalizer of the invention connected thereto.

The totalizer, generally, is assembled on a base plate 10 adapted to be mounted on a wall 12 of a standard gasoline pump. Coacting parts of the pump are shown in FIG. 4. Rectangularly arranged frame bars 14, 16, 18 and 20 are secured to the outer surface of the plate. They slidably and rotatably support the individual totalizer shafts 22A, 22B and others not numbered, and a drive shaft 24 common to the totalizer shafts. Bevel gears 26A and 26B on the totalizer shafts mesh with gears 28A and 28B when the shafts are moved to the left as is shaft 22B and gear 26B. Coils springs 30 bias the shafts out of engagement with the drive shaft. The totalizers have numeral discs or wheels 32 and function in the usual manner to record revolutions of the shafts 22. In the common drive shaft 24 drives from bevel gears 34 and a shaft 36 which is connected by a flexible shaft 38 to the main recorder or totalizer of the pump as will be described presently.

A rock or pivot shaft 40 is supported alongside of frame bar 20 and pivotally supports actuating levers or fingers 42. A key lock and detent assembly indicated generally at 44 is carried by the plate 10 alongside of the fingers 42. An angle member 46 supports a lock body 48 and lock cylinder 50 for each finger 42. When a key 52 is inserted in any cylinder, that cylinder may be depressed to compress the spring 54 under the cylinder and a pawl or lug 56 on top of the spring. A selector bar 58 bent downwardly from the lug 56 projects downwardly below the plate 10 between two detents or detent slide bars 60 and 62 to be described presently. Downward movement of the lug 56 engages a U-bend 64 on its end with the finger 42 associated with the lock 48. The totalizer shaft such as the shaft 22B associated with the finger 42B is pushed to the left to engage its bevel gear 26B with the gear 28B on the shaft 24. The totalizer wheels 32 on the engaged shaft accordingly record each rotation of shaft 22B.

Figure 1:
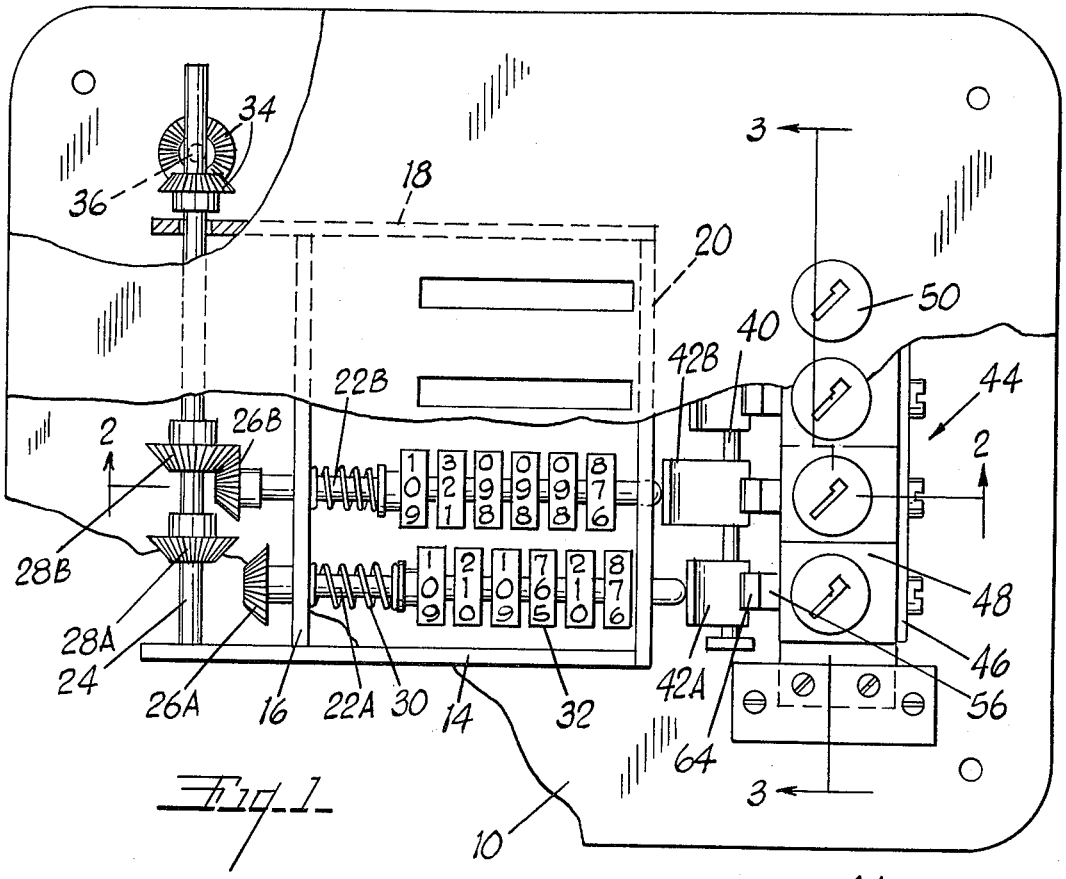
FIG. 1 is a front elevational view of the totalizer with parts broken away.
Figure 2:
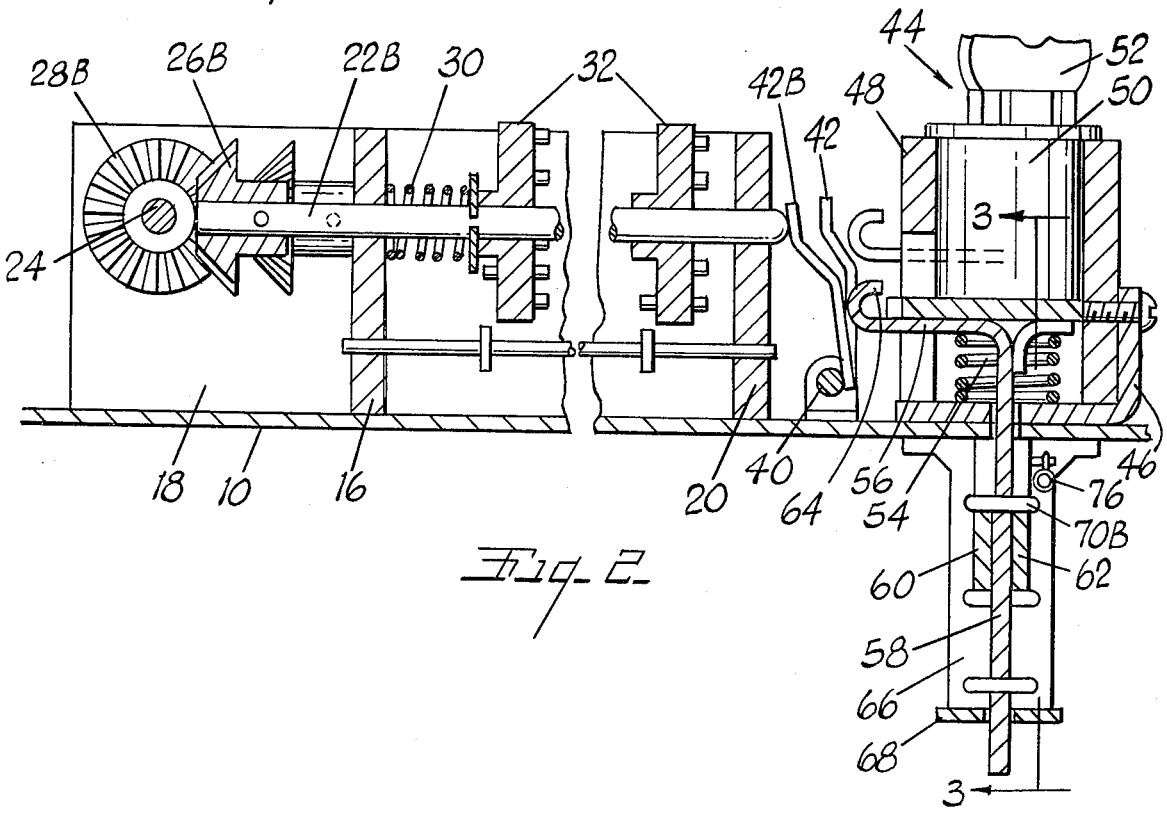
FIG. 2 is an enlarged fragmentary cross sectional view taken along the plane of the line 2—2 in FIG. 1.

Below or behind plate 10, plates 66 have slots slidably supporting the detent bars 60 and 62 with the selector bars 58 of the several lock assemblies extending between and across the detents. A bottom plate 68 secured to the ends of the plates 66 has slots therein passing and guiding the lower ends of the selector bars. Each selector bar has a cross pin 70B which projects through detent openings in the detent bars 60 and 62. The front detent 62 in FIG. 3, which is the right detent 62 in FIG. 2, has openings with an inclined edge 72 and a retaining notch 74 on its lower end. As the cross pin 70B on any selector bar is pressed down against its spring 54, detent 62 is pushed rearwardly or to the right in FIG. 3 until the pin enters the notch 74 and the detent is pulled forwardly by a coil spring 76. At the same time the other end of the cross pin 70B moves along a cam edge 78 in an angled opening in the other detent 60, moving detent 60 forwardly or to the left in FIG. 3. The detent 60 is biased rearwardly or to the right in FIG. 3 by spring 80. The other pins 70B which are not actuated by their lock cylinders remain raised and are locked or retained in that position by the notches 82 in detent 60. Before the cylinder of lock 50 and the totalizer 22B–32 can be returned to their original unengaged position, detent 62 must be returned to the right. The assembly of the locks 42, selector bars 58 and detents 60 and 62 is old in the art of business and adding machines and so is not described in detail. Detent 60 is a control detent in that it moves to the left in FIG. 3 when any lock is actuated, and detent 62 is both a blocking and release detent in that it must be moved to the right to release any depressed selector bar 58 before another can be depressed.

In order to utilize the locking and releasing properties of the key lock and detent mechanism in conjunction with the totalizer mechanism and the standard sales register of existing gasoline pumps a switch 84 is mounted on the inside of the pump body 12. The switch has an actuating lever or spring 86 positioned to be depressed to close the switch when the end of detent or slide bar 60 is displaced against the tension of spring 80 by any one of the selector bars 58. As previously noted, the remaining selector bars and their actuating lock cylinders are then blocked by their pins 70B being retained in the notches 82.

Figure 3:
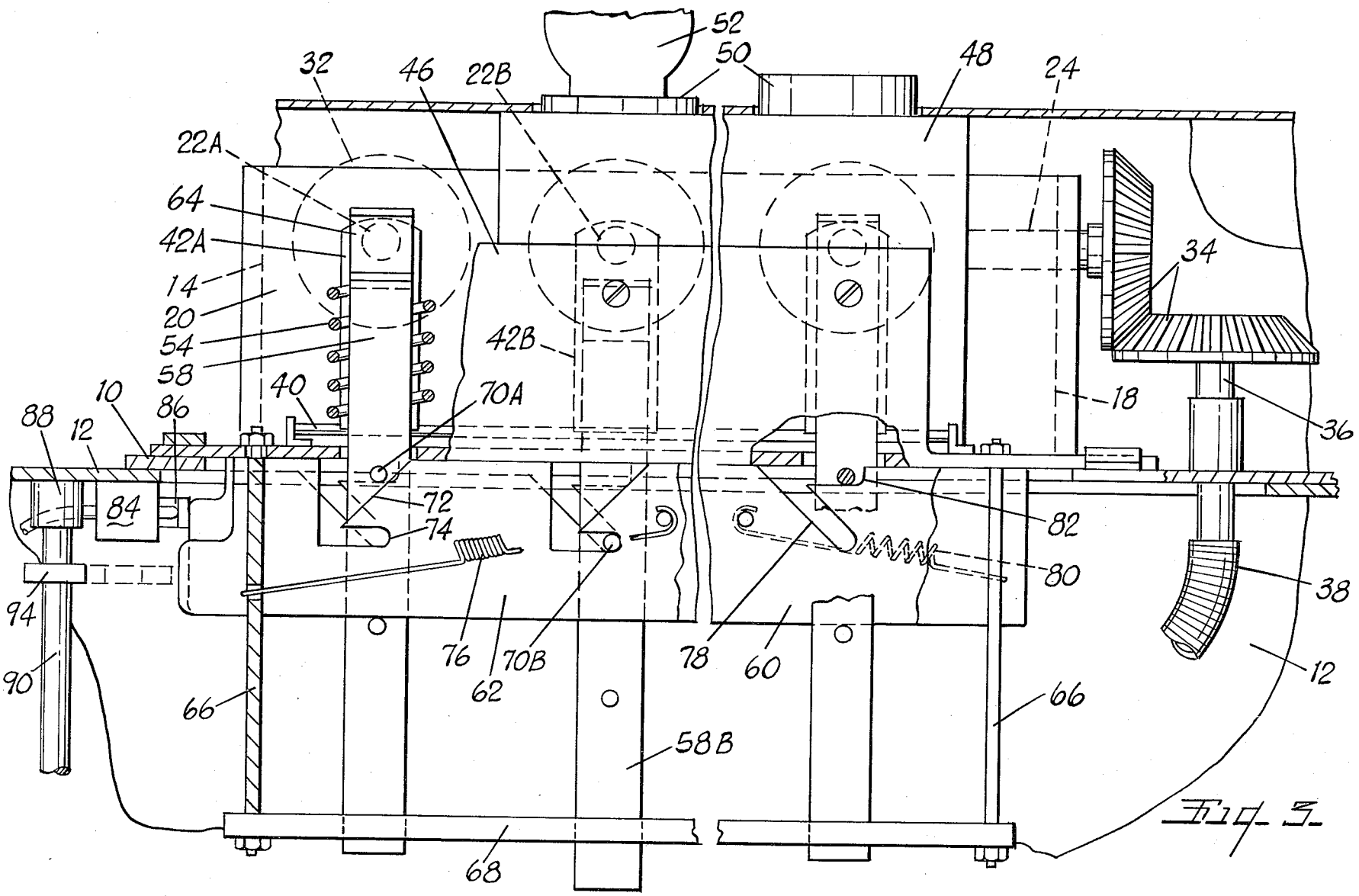
FIG. 3 is a cross sectional view taken along the plane of the line 3—3 in FIG. 2 and looking in the direction of the arrows, parts being broken away.

The base plate 10 of the totalizer is further provided with a bearing support 88 for one end of an extension shaft 90, see FIGS. 3 and 4, which is drivingly engagable with the on-off shaft 92 of the standard register of the pump. The shaft 90 carries a lever 94 which rotates upwardly to engage and push the end of release detent 62 upwardly or to the right in FIG. 3 when the pump is turned off after a prior sale. The existing standard sales register has dial wheels 96 which register the dollar value of a sale, and dial wheels 98 which register the gallon value of the sale. These are driven by a shaft 100 driven by a flow meter 102. The pump 104 which supplies the meter and delivery hose 106 is driven by the motor 108 (see FIG. 4). Alternatively, the motor-pump combination may be replaced by an electrically actuated valve (not shown) which controls delivery to the flow meter from a continuously operating pump serving several sales registers. In either case, the register proper has an explosion proof switch 110. The switch is connected to the shaft 92 by linkage 112 to close the switch in the motor energizing circuit 114 to the delivery control, such as the motor shown. Spring actuated and mechanically interlocked mechanism (contained in part in the housing 116 in FIG. 4) loads the springs when the on-off handle 118 is moved to the off position shown. Before the switch can be reclosed, a reset lever 120 and shaft 122 must be turned by the operator so that the spring mechanism zeros the dials 96 and 98 and frees shaft 92 to reclose switch 110 by operation of handle 118. The switch 84 of the invention is electrically connected by cable 124 in series with existing switch 110 in the energizing circuit 114 to the motor or other supply control device.

When the existing sales pump is provided with the plural totalizers and key operated mechanical connections of the invention, an operator may move the lever 120 to zero the dials 96 and 98, only when the lever 118 and switch 110 have been moved to full off position. In these positions of shafts 90 and 92, the lever 94 has tripped detent 60 and released pin 70B of previously depress selector bar 58B so that spring 54 moves the associated lock cylinder to retracted position. Totalizer shaft 22B moves to the right in FIG. 3, disengaging the drive to that totalizer. The existing controls 118 and 120 can thus be used as before, but before any delivery and sale can be made one of the non-resettable totalizers must be engaged to close the switch 84. An operator can thus be required to use a key which can be issued to him so that he becomes responsible for all sales recorded on the totalizer associated with his key.

What is claimed to be new and what is desired to be secured by Letters Patent is defined in the following claims:

1. In combination with a gasoline sales pump having an electrically actuated delivery device which delivers through a flow meter driving the meter, and a resettable sales register having a manually operable lever arranged to actuate said delivery device between on and off positions and to zero the register only when the lever has been returned to off position, plural non-resettable accumulation registers comprising a common drive shaft having plural gears and being connected to be driven by said sales register, plural register shafts each having a drive gear axially movable to engage a different gear on said common shaft, plural key operated locks having axially shiftable cylinders and spring biased selector bars with laterally extending arms each arranged to shift one of said gears on one of said register shafts into engagement with said common shaft, slidable detent bars mounted in crossing relation to said selector bars and spring biased oppositely, said detent bars having oppositely inclined cam slots therein, pins on said selector bars engagable with said cam slots, an electric switch having an actuating element positioned to be moved to closed position by movement of a first one of said detent bars against its spring bias as a control detent, a second one of said detent bars having retaining notches arranged to receive the pin of a first actuated selector bar as a release detent, said first control detent having blocking notches engagable with the pins on all but the first actuated selector slide, a release shaft connected to the reset mechanism of said register, and a lever on said last shaft arranged to move said second release detent against its spring bias and release the pin of the first actuated selector slide when said register reset mechanism is actuated, said electric switch being connected in series with said electrically actuated delivery device of said sales pump.

2. The combination as defined in claim 1 in which said accumulation registers and key operated locks are mounted on a plate attached over an opening in a wall of said sales pump, with said detent bars and said release shaft being mounted on the inner side of said plate, with said selector bars projecting through openings in the plate.

3. The combination as defined in claim 2 in which said electrically actuated delivery device of said pump is a switch connected to the driving motor of the pump.

4. Key operated numerical accumulating mechanism for selectively accumulating totals generated by a resettable register having an on-off switch, driven means arranged to introduce numerical figures into the register when the switch is on, and a reset control interlocked with said switch to zero the register when the switch is off, said mechanism comprising:

means supporting plural sets of totalizing gears and axially shiftable driven gears for each set, a drive shaft having gears thereon, each engagable with a separate one of said driven gears, means biasing said driven gears out of engagement with said gears on said drive shaft, a plurality of key operated locks each having a cylinder associated with a different one of said sets of dials to engage the driven gear thereof with a gear on said drive shaft, separate spring means biasing each of said cylinders out of totalizer engaging position, a selector slide member associated with with each one of said cylinders, first detent means yieldably engagable with all said slide members and movable with a first actuated one of said members into blocking relation to the others of said slide members, second detent means yieldably engagable with said slide members and spring biased to retaining engagement with a first actuated slide member in the actuated position thereof, switch means positioned to be closed by movement of said first detent means by a first actuated one of said selector slide members and adapted to be connected in series with the on-off switch of said resetable register, and release means positioned to move said second detent means out of retaining position with a first actuated one of said selector members and adapted to be moved by movement of said reset control when actuated.

5. Key operated accumulating mechanism as defined in claim 4 in which said key operated cylinders of said locks are movable axially transversely to the ends of the shafts of said sets of totalizing shafts, and means cammingly engagable between said cylinders and the ends of the totalizer shafts to engage the totalizer dials with said drive gears.

* * * * *